United States Patent [19]

Nagai et al.

[11] Patent Number: 4,690,881

[45] Date of Patent: Sep. 1, 1987

[54] LIQUID DEVELOPER FOR ELECTROPHOTOGRAPHY

[75] Inventors: Kayoko Nagai; Kazuo Tsubuko, both of Numazu, Japan

[73] Assignee: Ricoh Co., Ltd., Tokyo, Japan

[21] Appl. No.: 856,075

[22] Filed: Apr. 24, 1986

[30] Foreign Application Priority Data

May 13, 1985 [JP] Japan ..... 60-100882

[51] Int. Cl.[4] ..... G03G 9/12

[52] U.S. Cl. ..... 430/114; 430/115

[58] Field of Search ..... 430/110, 115, 114

[56] References Cited

U.S. PATENT DOCUMENTS 4,595,646 6/1986 Tsubuko et al. ..... 430/115

*Primary Examiner*—John L. Goodrow

*Attorney, Agent, or Firm*—Flynn, Thiel, Boutell & Tanis

[57] ABSTRACT

The present invention relates to a liquid developer for electrophotography having a solid content of not less than 10% by weight and the diffusion speed (as defined in the specification) of not lower than 1 mm/min., which comprises a toner containing a coloring agent covered with a resin and an aliphatic hydrocarbon dispersing medium dispersing said toner therein, wherein said coloring agent comprises a resinous composition containing an ethylene-vinylacetate copolymer as the essential component, which disperses therein a pigment coated with at least one of humic acid, humate and humic acid derivatives, and said toner comprises said coloring agent covered with a resinous composition containing a polymer prepared from a composition containing Monomer I of the following general formula, $$CH_2{=}\overset{\overset{\displaystyle R}{|}}{C}{-}A$$

(wherein R represents hydrogen or methyl group and A represents $-COOC_nH_{2n+1}$ or $-OCOC_nH_{2n+1}$, n being an integer of 6 to 20) and Monomer II having an allyl group as the essential components.

8 Claims, 2 Drawing Figures

LIQUID DEVELOPER FOR ELECTROPHOTOGRAPHY

BACKGROUND OF THE INVENTION

1. Field of the Invention

The present invention relates to a liquid developer for electrophotography, and the present invention can also be applied to printing ink, paint and the like.

2. Description of the Prior Art

A wet type developer for electrophotography uses an aliphatic hydrocarbon having a high boiling point as a dispersing medium. According to the wet type developing system, a developed toner image is fixed when the aliphatic hydrocarbon in the toner diffuses in a copy paper and evaporates in air.

The conventional liquid developer for electrophotography has disadvantages that its fixativity is not good and consequently that an image of the conventional liquid developer on a copy paper sometimes disappears when rubbed by a finger immediately after a copy is made by the conventional wet type developing copier. This is probably because the diffusion speed of an aliphatic hydrocarbon is low and accordingly the aliphatic hydrocarbon in a toner layer on the copy paper remains for a while.

Carbon and other pigments usually have a porous surface and are liable to adsorb an aliphatic hydrocarbon in a developer on their surfaces. The conventional resin used in the preparation of a coloring agent, including carbon and/or pigments, is easily swellable with the aliphatic hydrocarbon used in the conventional liquid developer, and therefore it is not effective for preventing the aliphatic hydrocarbon from being contained in the coloring agent. Thus, the diffusion speed of the aliphatic hydrocarbon of the conventional developer is low.

Under these circumstances, it is desired to prepare a new developer using a resin effective for preventing an aliphatic hydrocarbon from being contained in a coloring agent, which fixativity is improved by making the diffusion speed of the aliphatic hydrocarbon higher.

SUMMARY OF THE INVENTION

An object of the present invention is to provide a novel liquid developer for electrophotography, which is improved in its fixativity immediately after development.

Thus, an object of the present invention is to provide a liquid developer for electrophotography having a solid content of not less than 10% by weight and a diffusion speed (as defined hereinafter) of not lower than 1 mm/min., which comprises a toner containing a coloring agent covered with a resin and an aliphatic hydrocarbon dispersing medium dispersing said toner therein, wherein said coloring agent comprises a pigment coated with at least one of humic acid, humate and humic acid derivatives, which pigment is dispersed in a resinous composition containing an ethylene-vinylacetate copolymer as the essential component, and said toner comprises said coloring agent covered with a resinous composition containing a polymer prepared from a composition containing Monomer I of the following general formula, $$CH_2{=}\overset{\overset{\displaystyle R}{|}}{C}{-}A$$

(wherein R represents hydrogen or methyl group and A represents $-COOC_nH_{2n+1}$ or $-OCOC_nH_{2n+1}$, n being an integer of 6 to 20) and Monomer II having an allyl group as the essential components.

BRIEF DESCRIPTION OF THE DRAWINGS

FIG. 1 illustrates a diffusion process of an aliphatic hydrocarbon dispersion medium.

DETAILED DESCRIPTION OF THE INVENTION

The liquid developer for electrophotography of the present invention comprises a resin, coloring agent and aliphatic hydrocarbon dispersion medium. The resin and coloring agent are used in a weight ratio of resin/coloring agent=0.3−10/1, and the aliphatic hydrocarbon dispersion medium is used in an optional effective amount.

The resin is easily adsorbed on the coloring agent, and is dispersed in the aliphatic hydrocarbon solvent. The coloring agent comprises a pigment, polyethylene-vinylacetate copolymer and at least one of humic acid, humate and humic acid derivatives. The coloring agent is prepared by flushing process. The polyethylene-vinylacetate copolymer is not swellable with the aliphatic hydrocarbon dispersion medium.

Examples of the aliphatic hydrocarbon solvent include an isoparaffin type hydrocarbon such as isododecane, paraffin type hydrocarbon such as n-hexane, and a mixture of paraffin type, naphthene type and aromatic hydrocarbons. Commercially available examples of them include "Shell Sol.−71" of Shell Petroleum Co., "Isopar.−G, H, L, E, K" of Exxon Corp., and the like.

The aliphatic hydrocarbon dispersion medium of the liquid developer of the present invention rapidly diffuses into a copy paper immediately when a toner image is copied on the copy paper from the developer. Thus, the developer of the present invention is improved in its primary fixativity since the solvent speedily diffuses into a copy paper and evaporates in air. This speedy diffusion of the solvent is mainly due to the properties of the resin which is not swellable and not impregnated with the solvent.

Figure 1A:
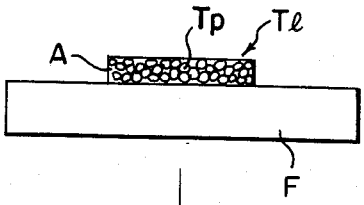
FIGS. 1A, 1B and 1C illustrate a structure of the liquid developer of the present invention.
Figure 1B:
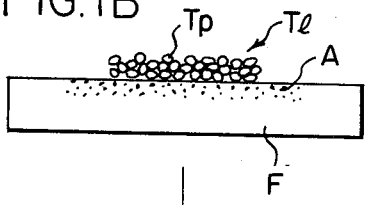
Figure 1C:
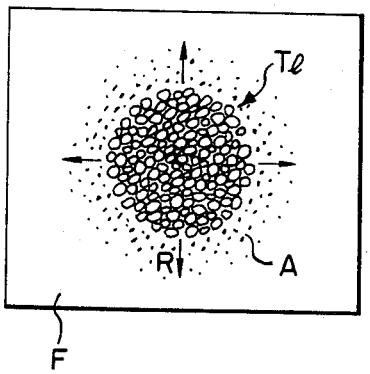

The diffusion speed of the dispersion medium of toner is measured in the following manner. As can be seen from FIGS. 1A, 1B and 1C, 0.3 g of a developer (having a solid content of not lower than 10% by weight) picked up by a volumetric syringe is dropped at a height of 10 mm on a "filter paper No. 2" of Toyo Roshi Ltd. (indicated as "F" in FIGS. 1A, 1B and 1C). The developer thus dropped forms a circular toner layer "Tl" having a diameter of about 5 mm, and the dispersion medium "A" of the toner diffuses around the circular toner layer, leaving toner particles "Tp" as they are. The diffusion speed R is then measured under the conditions of 20° C. and a relative humidity of 65%. It has been found that the diffusion speed R thus measured should be not lower than 1 mm/minute in order to obtain a satisfactory primary fixativity, and that the higher the diffusion speed is, the more satisfactory fixativity can be obtained.

Figure 2:
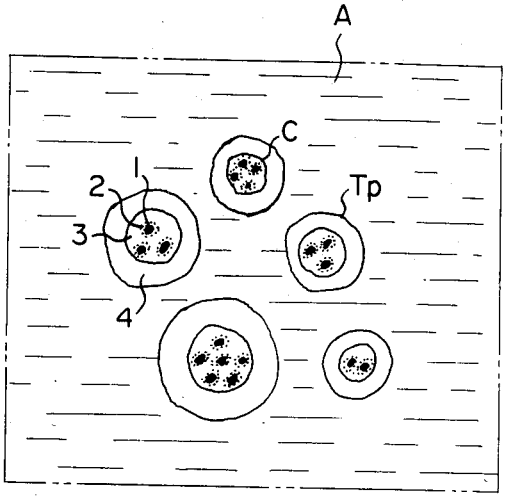

FIG. 2 illustrate a structure of the liquid developer of the present invention, wherein 1 indicates a pigment; 2 indicates humic acid and the like; 3 indicates an ethylene-vinylacetate copolymer and the like; 4 indicates an acrylate resin and the like; and A indicates an aliphatic hydrocarbon dispersion medium. The developer of the present invention is prepared by (i) coating pigment 1 with humic acid 2, (ii) dispersing the pigment coated with humic acid in ethylene-vinylacetate copolymer 3 to form a coloring agent "C", (iii) kneading the formed coloring agent "C" with an acrylate resin 4 to form a toner particle "Tp", and (iv) dispersing the formed toner particle "Tp" in an aliphatic hydrocarbon dispersing medium "A". The above coloring agent is formed by flushing process. The coloring agent thus flushed with ethylene-vinylacetate copolymer becomes not impregnated with an aliphatic hydrocarbon dispersion medium. This is due to the properties of ethylene-vinylacetate copolymer which is not swellable with an aliphatic hydrocarbon.

The general structure of a coloring agent particle and a method for producing the same are fully described in Japanese Patent Laid Open No. 59-102253.

The coloring agent of the present invention is characterized by using polyethylene-vinylacetate copolymer as the essential component in its preparation, together with at least one of humic acid, humate and humic acid derivatives.

The weight ratio of pigment/humic acid/resin is preferable 1/0.001 – 1/0.5 – 9.

Examples of inorganic pigments used in the coloring agent include carbon black such as furnace black, acetylene black, channel black and the like, and their commercially available examples include Printex G, Printex V, Special Black 15, Special Black 4, Special Black 4-B (Degussa, Inc.), Mitsubishi #44, #30, MA-11, MA-100 (Mitsubishi Carbon), Laven 30, Laven 40, Conductex SC (Columbia Carbon), Regal 400, 660, 800, Black Pearl L (manufactured by Cabot Co.) and the like. Examples of white inorganic pigments include zinc oxide, titanium oxide, silicon oxide and the like.

Examples of organic pigments used in the coloring agent include Phthalocyanine Blue, Phthalocyanine Green, Rhodamine Lake, Malachite Green Lake, Methyl Violet Lake, Peacock Blue Lake, Naphthol Green B, Permanent Red 4 R, Hansa Yellow, Benzidine Yellow, Thioindigo Red and the like.

These pigments may be used respectively alone or in a mixture.

It is essential that a resin used for coating a pigment should contain at least ethylene-vinylacetate copolymer. In addition to the ethylene-vinylacetate copolymer, the coating resin may optionally contain paraffin wax, polyolefine, acrylic resin, rosin-modified resin, styrene-butadiene resin, natural resin or a mixture thereof.

Examples of ethylene-vinylacetate copolymer include the following commerially available products.

| Brand Name | Vinylacetate Content | Softening Point |
|---|---|---|
| Marker: Mitsui-Du Pont Polychemical Ltd. | | |
| Everflex 45X | 46% by weight | 94° C. |
| Everflex 40X | 41 | 98 |
| Everflex 150 | 33 | 120 |
| Everflex 210 | 28 | 85 |
| Everflex 220 | 28 | 90 |
| Everflex 250 | 28 | 135 |
| Everflex 260 | 28 | 155 |

-continued

| Brand Name | Vinylacetate Content | Softening Point |
|---|---|---|
| Everflex 310 | 25 | 90 |
| Everflex 360 | 25 | 185 |
| Everflex 410 | 19 | 90 |
| Everflex 420 | 19 | 100 |
| Everflex 450 | 19 | 135 |
| Everflex 560 | 14 | 170 |
| Everflex P-1403 | 14 | 70 |
| Everflex P-1207 | 12 | 70 |
| Everflex P-0607 | 6 | 72 |
| Maker: Toyo Soda Ltd. | | |
| Ultrathene UE631 | 20% by weight | 92° C. |
| Ultrathene UE634 | 26 | 81 |
| Ultrathene UE630 | 15 | 97 |

Examples of paraffin wax and polyolefine include the following commercially available products.

| Maker | Brand Name | Softening Point |
|---|---|---|
| Allied Chemical Corp. | AC Polyethylene 1702 | 85° C. |
| | AC Polyethylene 617,617A | 102 |
| | AC Polyethylene 9,9A | 117 |
| | AC Polyethylene 430 | 60 |
| | AC Polyethylene 405 | 96 |
| | AC Polyethylene 401 | 102 |
| | AC Polyethylene 540 | 108 |
| | AC Polyethylene 580 | 108 |
| Eastman Kodak Co. | Epolene N-14 | 105° C. |
| | Epolene E-15 | 96 |
| Sanyo Chemical Industries Ltd. | Sun Wax 131-P | 108° C. |
| | Sun Wax 151-P | 107 |
| | Sun Wax 161-P | 111 |
| | Sun Wax 165-P | 107 |
| | Sun Wax 171-P | 105 |
| | Sun Wax E-250P | 102 |
| | Sun Wax E-300P | 98 |
| Junsei Yakuhin Ltd. | Paraffin Wax | 40–90° C. |
| Hoechst | PED 521 | 104° C. |
| | PED 543 | 110 |
| | PED 153 | 99 |
| Yasuhara Yushi | Neowax L | 105 |
| | Neowax E | 100 |

Preparation examples of a coloring agent of the present invention are illustrated hereinafter.

A coloring agent comprising a pigment coated with resin is prepared preferably by the flushing process, but it may be prepared by other dispersing methods. In the dispersion step, humic acid, humate or humic acid derivatives are used.

Coloring Agent Preparation Example 1

Ammonium humate 20 g was fully dissolved in water 200 g in a gallon kneader, and carbon black (Mitsubishi #44) 250 g was then fully mixed with and dispersed in the above solution in the kneader. Ethylene-vinylacetate copolymer ("Everflex 45X" manufactured by Mitsui-Du Pont Polychemical Ltd.) 750 g was then admixed and kneaded with the above prepared dispersion while heating at 100° C., and water was separated.

The mixture thus obtained was futher kneaded at 120° C. for 4 hours, and the content was then subjected to vacuum drying, cooling and pulverizing, thus producing a coloring agent.

Coloring Agent Preparation Example 2

Sodium humate 10 g was dissolved in water 200 g in a gallon kneader, and carbon black ("Morgal A" manufactured by Columbia Carbon Co.) 250 g was then fully mixed with and dispersed in the above solution in the kneader. "Everflex 210" 300 g and "Sun Wax 151P" 300 g were then admixed and kneaded with the above prepared dispersion while heating at 150° C. The mixture was further heated at 120° C. for 2 hours, and the content was then subjected to vacuum drying, cooling and pulverizing, thus producing a coloring agent.

Coloring Agent Preparation Examples 3 to 10

Coloring agents were prepared in the same manner as in the above Example 1, except for using the materials listed below.

| Examples | Water | Humic Acid | Pigment | Resin | |
|---|---|---|---|---|---|
| 3 | 150 | ammonium humate | 25 g Printex V | 300 g Ultrathene 630 | 200 g |
| | | | | PED 521 | 250 g |
| 4 | 150 | ammonium humate | 25 g Printex V | 300 g Everflex 210 | 50 g |
| | | | | Sun Wax 250p | 300 g |
| 5 | 250 | ammonium humate | 25 g Regal | 400, 300 g Ultrathene 600 | 80 g |
| | | | | Bee Wax | 250 g |
| 6 | 250 | humic acid | 50 g Regal | 400, 300 g Everflex 310 | 50 g |
| | | | | Paraffin Wax 64° C. | 200 g |
| 7 | 100 | humic acid | 50 g Phthalocyanine Blue | 250 g Everflex 410 | 300 g |
| 8 | 100 | humic acid | 50 g Phthalocyanine Green | 250 g Everflex 560 | 50 g |
| | | | | Sun Wax 171p | 280 g |
| 9 | 100 | potassium humate | 5 g Thioindigo Red | 300 g Everflex 150 | 300 g |
| 10 | 100 | potassium humate | 5 g Printex G | 250 g Everflex 360 | 80 g |
| | | | Alkali Blue | 50 g BR-102 (Acrylic Resin) | 80 g |

The composition of a resin to be kneaded with the above prepared coloring agents in accordance with the present invention and a method for producing the same are illustrated hereinafter.

The resinous composition used in the preparation of a toner of the present invention contains a polymer polymerized from a composition containing Monomer I of the following general formula, $$CH_2{=}\overset{\overset{\displaystyle R}{|}}{C}{-}A$$

(wherein R represents hydrogen or methyl group and A represents $-COOC_nH_{2n+1}$ or $-OCOC_nH_{2n+1}$, n being an integer of 6 to 20) and Monomer II having an allyl group as the essential components. A solvent used in the above polymerization is an aliphatic hydrocarbon.

Examples of the above Monomer I include lauryl methacrylate, lauryl acrylate, stearyl methacrylate, stearyl acrylate, 2-ethylhexyl methacrylate, 2-ethylhexyl acrylate, dodecyl methacrylate, dodecylacrylate, hexyl methacrylate, hexyl acrylate, octyl methacrylate, octyl acrylate, cetyl methacrylate, cetyl acrylate, vinyl laurate, vinyl stearate, and the like.

Examples of the above Monomer II having an allyl group include allyl methacrylate, allyl acrylate, allyl propyl methacrylate, allyl propyl acrylate, allyl butyl methacrylate, allyl butyl acrylate, allyl pentyl methacrylate, allyl pentyl acrylate, allyl hexyl methacrylate, allyl hexyl acrylate, and the like.

Preparation examples of the above resin used for coating a coloring agent are illustrated hereinafter.

Resin Preparation Example 1

Isododecane 1000 g was placed in a two liter four-necked flask, and was heated at 90° C. Stearyl methacrylate 300 g, allyl methacrylate 20 g and benzoyl peroxide 3 g were dropped therein over one hour. After dropping, polymerization was conducted at 90° C. for 6 hours, and vinylacetate monomer 100 g and azobisisobutyronitrile 4 g were then dropped therein over one hour. After dropping, polymerization was conducted at 90° C. for 6 hours to produce a resin of polymerization rate of 93.8% having a viscosity of 380 cps.

Resin Preparation Example 2

"Isopar H" 1000 g was placed in a two liter four-necked flask, and was heated at 85° C. Lauryl methacrylate 300 g, glycidyl methacrylate 20 g, methacrylate acid 3 g, allyl methacrylate 10 g and benzoyl peroxide 2 g were dropped therein over one hour and one-half. After dropping the monomers, polymerization was conducted at 90° C. for 5 hours, and pyridine 0.2 g was then added. The contents were then further stirred at 90° C. for 2 hours, and methyl methacrylate 80 g and azobisisobutyronitrile 4 g were dropped therein over one hour. After dropping, polymerization was further conducted at 90° C. for 3 hours to produce a resin of polymerization rate of 95.0% having a viscosity of 530 cps.

Resin Preparation Example 3

Isododecane 1000 g was placed in a two liter four-necked flask, and was heated at 90° C. Lauryl methacrylate 300 g, allylpropyl methacrylate 20 g, itaconic acid 2 g and benzoyl peroxide 3 g were dropped therein over one hour. After dropping, polymerization was conducted at 90° C. for 6 hours, and vinylacetate monomer 100 g and azobisisobutyronitrile 4 g were then dropped therein over one hour. After dropping, polymerization was conducted at 90° C. for 6 hours to produce a resin of polymerization rate of 93.0% having a viscosity of 130 cps.

Resin Preparation Example 4

Isododecane 1000 g was placed in a two liter four-necked flask, and was heated at 90° C. Stearyl acrylate 300 g, allylbutyl acrylate 10 g, fumaric acid 4 g and benzoyl peroxide 3 g were dropped therein over one hour. After dropping, polymerization was conducted at 90° C. for 6 hours, and n-butyl methacrylate monomer 100 g and azobisisobutyronitrile 4 g were then dropped therein over one hour. After dropping, polymerization was conducted at 85° C. for 6 hours to produce a resin of polymerization rate of 96.4% having a viscosity of 890 cps.

Resin Preparation Example 5

Isopar G 1000 g was placed in a two liter four-necked flask, and was heated at 90° C. 2-ethylhexyl acrylate 300 g, allylhexyl methacrylate 30 g, diethylaminoethyl methacrylate 2 g and benzoyl peroxide 3 g were dropped therein over one hour. After dropping, polymerization was conducted at 90° C. for 6 hours, and methyl methacrylate monomer 100 g and azobisisobutyronitrile 4 g were then dropped therein over one hour. After dropping, polymerization was conducted at 85° C. for 6 hours to produce a resin of polymerization rate of 92.8% having a viscosity of 260 cps.

Resin Preparation Example 6

Isopar G 1000 g was placed in a two liter four-necked flask, and was heated at 90° C. Decyl acrylate 300 g, allylheptyl methacrylate 10 g, glycidyl methacrylate 3 g and benzoyl peroxide 3 g were dropped therein over one hour. After dropping, polymerization was conducted at 90° C. for 6 hours, and vinyltoluene monomer 200 g and azobisisobutyronitrile 4 g were then dropped therein over one hour. After dropping, polymerization was conducted at 85° C. for 6 hours to produce a resin of polymerization rate of 97.7% having a viscosity of 480 cps.

Finally, a toner is prepared in the following manner.

Dispersion is carried out by using a ball mill, attritor, vibratory mill or the like.

A coloring agent is mixed with a resin preferably in a weight ratio of coloring agent/resin=1/0.3−10. Solid content is controlled by adding an appropriate amount of an aliphatic hydrocarbon dispersion medium. An appropriate dispersion time is 10 to 20 hours, thus producing a concentrated toner.

A developer is prepared by dispersing the above concentrated toner in an aliphatic hydrocarbon solvent in such a manner as to provide a solid content of at least 10% by weight.

The particle size of a toner dispersed in an aliphatic hydorcarbon solvent is preferably about 0.01μ−30μ, more preferably 0.1μ−20μ. When the particle size is smaller then 0.01μ, the toner particle also diffuses with the solvent, and therefore a copied image loses sharpness and resolving power, thus resulting in blur. On the other hand, when the particle size is larger than 30μ, the solvent is liable to be trapped among toner particles, thus drying properties being poor.

When the softening point of a coloring agent is too low, a toner layer formed on a photosensitive element becomes soft, and accordingly a copied image is sometimes broken. Thus, sharpness and resolving power becomes inferior.

In such a case, the soft toner is improved by dispersing large particles having an average size of not smaller then 1 μm in the toner. Examples of particles preferably used for this purpose include powdery high molecular materials such as vinyl chloride resin, styrene resin, acrylic resin, phenolic resin, rosin-modified resin, petroleum resin, butadiene resin, polyolefine, and other particulate resin obtained by suspension polymerization. Other particle examples for this purpose further include glass balloon, shirasu balloon, activated charcoal particles, toner for a dry type copier, and the like.

The present invention is further illustrated by the following Examples, but should not be limited thereto.

EXAMPLE 1

The following toner materials were placed in an attritor and dispersed for 10 hours at 40° C. to prepare a concentrated toner.

Coloring Agent of Preparation Example 1 300 g
Resin of Preparation Example 2 600 g After dispersion, isododecane was added to prepare a developer having a solid content of 10%.

The diffusion speed of the dispersion medium of the toner was measured in the following manner. 0.3 g of the above prepared developer picked up by a volumetric syringe was dropped at a height of 10 mm on a "filter paper No. 2" of Toyo Roshi Ltd., thus forming a toner layer of a diameter of about 5 mm. The diffusion speed of the dispersing medium was 2.5 mm/min.

EXAMPLE 2

The following toner materials were placed in a ball mill and dispersed for 20 hours at 30° C. to prepare a concentrated toner.

Coloring Agent of Preparation Example 1 400 g
Resin of Preparation Example 3 600 g After dispersion, Isopar H was added to prepare a developer having a solid content of 18%.

The diffusion speed of the dispersing medium measured in the same manner as in Example 1 was 2.3 mm/min.

EXAMPLE 3

The following toner materials were placed in a ball mill and dispersed for 15 hours at 40° C. to prepare a concentrated toner.

Coloring Agent of Preparation Example 3 400 g
Resin of Preparation Example 4 600 g
Resin Powder ("BR-102" Acrylic Resin of Mitsubishi Rayon)

After dispersion, Isopar G was added to prepare a developer having a solid content of 20%.

The diffusion speed of the dispersing medium measured in the same manner as in Example 1 was 3.5 mm/min.

EXAMPLE 4

The following toner materials were placed in a attritor and dispersed for 10 hours at 40° C. to prepare a concentrated toner.

Coloring Agent of Preparation Example 4 500 g
Resin of Preparation Example 5 500 g After dispersion, Isopar H was added to prepare a developer having a solid content of 50%.

The diffusion speed of the dispersing medium measured in the same manner as in Example 1 was 2.6 mm/min.

EXAMPLE 5

The following toner materials were placed in a three-roll mill and kneaded.

Coloring Agent of Preparation Example 7 1000 g
Resin of Preparation Example 6 1000 g After 4 hours, the kneaded product was diluted with 500 g of isodecane to prepare a toner. The toner thus prepared was put into a polyethylene tube container.

The diffusion speed of the dispersing medium measured in the same manner as in Example 1 was 1.1 mm/min.

100 g of toner was taken out from the tube container, and was diluted with 3 liters of isododecane. Copying was carried out by a wet type electrophotographic copying machine "NASHUA 4600" using the above prepared developer. As this result, it was proved that fixativity was excellent.

EXAMPLE 6

The following toner materials were placed in a ball mill and dispersed.

Coloring Agent of Preparation Example 8 500 g
Resin of Preparation Example 5 1000 g
"BR-89" Acrylic Resin of Mitsubishi Rayon 50 g
Isopar H 1500 g The diffusion speed of the dispersing medium measured in the same manner as in Example 1 was 1.8 mm/min.

200 g of toner was taken out from an aluminum tube container containing the above prepared toner, and was diluted with 3 liters of Isopar H. Copying was carried out by a wet type electrophotographic copying machine "NASHUA 4600" using the above prepared developer. As this result, it was proved that fixativity was quite satisfactory.

As mentioned above, the fixativity of the liquid developer of the present invention immediately after copying is highly improved because the diffusion speed of a dispersing medium is high.

What we claim is:

1. A liquid developer for electrophotography having a solid content of not less than 10% by weight and a diffusion speed (as defined in the specification) of not lower than 1 mm/min., which comprises a toner containing a coloring agent covered with a coating polymer an aliphatic hydrocarbon dispersing medium dispersing said toner therein, wherein said coloring agent comprises pigment particles coated with at least one material selected from the group consisting of humic acid, humates and humic acid derivatives, said coated pigment particles being dispersed in a resinous composition containing an ethylene-vinylacetate copolymer, and said coating polymer is a copolymer of Monomer I of the following general formula,

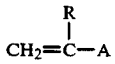

wherein R represents hydrogen or methyl group and A represents $-COOC_nH_{2n+1}$ or $-OCOC_nH_{2n+1}$, n being an integer of 6 to 20, and Monomer II having an allyl group.

2. The liquid developer for electrophotography as claimed in claim 1, wherein said aliphatic hydrocarbon dispersing medium is at least one medium selected from the group consisting of paraffin hydrocarbons, isoparaffin hydrocarbons and a mixture of paraffin hydrocarbons, naphthene hydrocarbons and aromatic hydrocarbons.

3. The liquid developer for electrophotography as claimed in claim 1, wherein said resinous composition comprises said ethylene-vinylacetate copolymer in combination with at least one material selected from the group consisting of paraffin wax, polyolefin, acrylic resin, rosin-modified resin, styrene-butadiene resin and natural resin.

4. The liquid developer for electrophotography as claimed in claim 1, wherein said Monomer I is at least one monomer selected from the group consisting of lauryl methacrylate, lauryl acrylate, stearyl methacrylate, stearyl acrylate, 2-ethylhexyl methacrylate, 2-ethylhexyl acrylate, dodecyl methacrylate, dodecyl acrylate, hexyl methacrylate, hexyl acrylate, octyl methacrylate, octyl acrylate, cetyl methacrylate, cetyl acrylate, vinyl laurate and vinyl stearate, and said Monomer II is at least one monomer selected from the group consisting of allyl methacrylate, allyl acrylate, allyl propyl methacrylate, allyl propyl acrylate, allyl butyl methacrylate, allyl butyl acrylate, allyl pentyl methacrylate, allyl pentyl acrylate, allyl hexyl methacrylate and allyl hexyl acrylate.

5. The liquid developer for electrophotography as claimed in claim 1, wherein the weight ratio of said pigment/humic acid/resinous composition in said coloring agent is 1/0.001–1/0.5-9, and the weight ratio of said coloring agent/resin in said toner is 1/0.3–10.

6. The liquid developer for electrophotography as claimed in claim 1, which is contained in a container.

7. A liquid developer for electrophotography having a solid content of not less than 10% by weight and a diffusion speed (as defined in the specification) of not lower than 1 mm/min., which comprises: toner particles dispersed in an aliphatic hydrocarbon dispersing medium, said toner particles comprising a core and a shell surrounding said core; said core consisting essentially of pigment particles coated with particles of a humic compound and dispersed within a continuous phase defining a matrix, said humic compound being selected from the group consisting of humic acid, humates and humic acid derivatives, said matrix being a resin composition comprising an ethylene-vinyl acetate copolymer; said shell comprising a copolymer of a Monomer I having the formula

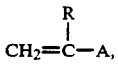

wherein R is hydrogen or methyl and A is $-COOC_nH_{2n+1}$ or $-OCOC_nH_{2n+1}$, wherein n is an integer of from 6 to 20, and Monomer II having an allyl group.

8. A liquid developer as claimed in claim 7 in which said humic compound is selected from the group consisting of ammonium humate, sodium humate, humic acid and potassium humate.

* * * * *